US005205664A

United States Patent [19]

Yushan et al.

[11] Patent Number: 5,205,664

[45] Date of Patent: Apr. 27, 1993

[54] LEAD-AUTO-SHARPENED PROPELLING PENCIL AND THE MAKING PROCESS THEREOF

[75] Inventors: Fu Yushan, No. 118, Xihonglu Road, Urumqi Shi, Xinjiang Autonomous Region; Zhang Ru, Urumqi Shi, both of China

[73] Assignee: Fu Yushan, China

[21] Appl. No.: 816,252

[22] Filed: Jan. 3, 1992

[30] Foreign Application Priority Data

Jan. 7, 1991 [CN] China ..... 91 1 00007.0

[51] Int. Cl.[5] ..... B43K 29/06; B43L 23/00

[52] U.S. Cl. ..... 401/50; 144/28.11; 30/454; 30/457

[58] Field of Search ..... 401/50; 144/28.11; 30/353, 454, 457, 460

[56] References Cited

U.S. PATENT DOCUMENTS

| | | | |
|---|---|---|---|
| 262,836 | 8/1882 | Schrag | 30/457 |
| 1,204,959 | 11/1916 | Duncan | 30/457 X |
| 1,228,672 | 6/1917 | Hill | 30/457 |
| 2,299,799 | 10/1942 | Correll . | |
| 2,333,714 | 11/1943 | Fletcher . | |
| 2,336,558 | 12/1943 | McCauley, Jr. . | |
| 2,366,928 | 1/1945 | Paschell . | |
| 2,485,441 | 10/1949 | Garrett . | |
| 2,519,625 | 8/1950 | Becker | 144/28.11 |
| 2,525,854 | 10/1950 | Becker | 30/454 |
| 2,626,593 | 1/1953 | Gwin, Jr. . | |
| 3,134,364 | 5/1964 | Chelazzi | 144/28.11 |
| 4,269,523 | 5/1981 | Kay . | |
| 4,513,798 | 4/1985 | Luttgens . | |

FOREIGN PATENT DOCUMENTS

| | | | |
|---|---|---|---|
| 0422671 | 4/1991 | European Pat. Off. . | |
| 253972 | 12/1948 | Switzerland | 30/454 |
| 799968 | 4/1979 | U.S.S.R. . | |

*Primary Examiner*—Danton D. DeMille

*Attorney, Agent, or Firm*—Roylance, Abrams, Berdo & Goodman

[57] ABSTRACT

The present invention provides a lead-auto-sharpened propelling pencil and a process of making it. The propelling pencil comprises a pencil body and a pencil cap. The pencil cap consists of a sharpener, a screwing insert and a powder remover. The process of sharpening the lead is automatically provided while the pencil cap is twisted onto the pencil body. The lead powder from sharpening is gathered in the powder remover so that the environment can be protected. The manufacturing process of the invention is that the cap case is moulded by the means of a cap case jig with the screwing insert and the sharpener installed by the means of a tapered jig. The manufacturing process according to the invention has broad application and is very practical.

4 Claims, 8 Drawing Sheets

LEAD-AUTO-SHARPENED PROPELLING PENCIL AND THE MAKING PROCESS THEREOF

INTRODUCTION

The present invention generally relates to a propelling pencil and a process of making thereof, and more particularly to a lead-auto-sharpened propelling pencil and the process of making thereof. The propelling pencil comprises a pencil body and a pencil cap which consists of a sharpener, which can automatically sharpen a lead, a powder remover and an outlet ring. In the process of manufacturing said propelling pencil, a plurality of positioning jigs are employed to ensure substantially exactly relative positions of the parts of the assembly. The lead held in the propelling pencil is automatically sharpened in the process of installing the pencil cap on the pencil body and therefore it is very convenient to use.

BACKGROUND OF THE INVENTION

Generally, there are several types of thicknesses of medium-soft (#2 or HB) black lead provided to use in known propelling pencils, for example, the black lead of which the diameter is 0.5 mm, 0.7 mm, and 0.9 mm. These black lead types need not be sharpened and can be used directly; but they have disadvantages that they are apt to break and are used in limited scope because of their single hardness type.

The hardness and strength of soft black lead types and colour lead types are so soft and weak, respectively, that they can not adapt to known propelling pencils because they are very apt to break with the same thickness as that of above medium-soft black leads. If these lead types are made into ones with thicker diameters there are also disadvantages in that they are not able to cooperate with the structure of the known propelling pencils and are inconvenient for a user to sharpen even if there is the adaptive structure of a propelling pencil.

And, future pencils shall not be wood holder pencils because they are not only inconvenient for a user to sharpen but also because they consume a large amount of quality wood.

A known pencil sharpener is not able to be employed to sharpen the leads of propelling pencils because the alignment between its blade and the lead is difficult to achieve.

In the structures of the known propelling pencils, a lead is kept only by the three claws at the front end of the lead holder, which restrict movement of the lead along its longitudinal axis. It, however, can rotate because the three claws hold it by only the three touching points. Thus, this is another reason why known pencil sharpeners are not able to adapt to sharpen the leads in known propelling pencils.

SUMMARY OF THE INVENTION

Thus, it is an object of the present invention to provide a lead-auto-sharpened propelling pencil, which is able to employ varied kinds of leads and automatically sharpen them in order to bring out various writing functions, to overcome the problems of the prior art.

It is another object of the present invention to provide a lead-auto-sharpened propelling pencil which has satisfactory performance, is not apt to break leads while sharpening, and does not pollute the environment because of having a powder gathering function.

It is a further object of the present invention to provide a process to manufacture the lead-auto-sharpened propelling pencil according to the invention easily, simply and effectually.

To these ends, the present invention provides a lead-auto-sharpened propelling pencil which comprises a pencil body and a pencil cap.

The pencil body consists of a body case, a lead holder, a screwing sleeve, a lead, a bolt and a compression spring. On the outside of the front portion of the body case, the screwing sleeve with outside screwthread is installed to cooperate with a screwing insert in the pencil cap and is coaxial with the tapered surface formed inside the front end of the body case.

The lead holder has a front tapered portion and a through hole, which passes through the center of the holder along its longitudinal axis and is substantially coaxial with the front tapered portion. The diameter of the front portion of the through hole (that is, the portion at the tapered portion of the holder) is less than that of its hind portion in order to snug the lead. There are more than one groove uniformally formed circumferentially around the front tapered portion of the lead holder and extending radially to the through hole.

A lead is inserted in the lead holder, and is held by means of resilience of its front tapered grooved portion. The lead holder is arranged inside the body case with its front tapered portion fitting with the inside surface of the front tapered portion of the body case so that the lead is automatically positioned along the longitudinal axis of the body case. The bolt is screwed in the hind end of the pencil body while the compression spring is compressed between the bolt and the lead holder.

The pencil cap comprises a screwing insert, a cap case, a sharpener and a powder remover. The screwing insert is a hollow cylinder with inside screwthread. The cap case is cylindrical with a hollow stepped chamber. The sharpener consists of a sharpener body, blades and a powder spacer. The sharpener body is cylindrical with a through hole in its center. A notch is formed in one end of the sharpener body. Six blade insertion grooves, which extend axially and radially to the through hole, are formed and spaced uniformally around the circumferential surface of the other end portions of the sharpener body. The blades, of which the edges are inclined with respect to its longitudinal axis, are adhered in these grooves, respectively, with their edges locating on an imaginary cone which is coaxial with the through hole of the sharpener body. The powder spacer is seated on the notch of the sharpener body.

The powder remover consists of a remover body and an outlet ring. The remover body is cylindrical with a flange in one end and a through hole in the center. A powder hole is radially formed on its circumferential surface and connects with the through hole. The circular outlet ring also has a through hole on its circumferential surface and is rotationally installed around the remover body. The screwing insert is coaxially positioned at one end of the cap case while the sharpener is coaxially adhered inside the cap case from its other end where the powder remover is adhered.

The cross sectional configuration of said blade can be symmetrical.

The blade can also be Γ-shape with the cross sectional configuration of its edge asymmetrical.

The process of making the lead-auto-sharpened propelling pencil according to the invention is as follows:

1. Making the body case and the screwing sleeve by the means of prior art, in which the concentricity between the screwing sleeve and the inside surface of the front tapered portion of the body case is ensured to be less than 0.1 mm.

2. Making the lead holder by the means of prior art, in which the concentricity, between its through hole and the outside surface of its front portion, is ensured to be less than 0.1 mm.

3. Making a cap case jig by tooling, in which the cap case jig is a stepped cylinder with the outside diameter of one of its end portions corresponding to the inside diameter of the screwing insert and the outside diameter of its other end portion to that of the sharpener body; and the concentricity between the two end portions is less than 0.05 mm.

4. Installing the screwing insert around the corresponding portion of the cap case jig so as to be a jig assembly to mould the cap case with the screwing insert by injection moulding.

5. Making a tapered jig by tooling. The tapered jig is a stepped cylinder with a tapered portion which has a corresponding cone to the portion of the lead sharpened. The cylindrical portion, which adjoins to the tapered portion, has a diameter corresponding to that of the central hole of the sharpener body. The total length of this portion and the tapered portion is equal to the longitudinal length of the sharpener body with blades minus the depth of the notch.

6. Inserting the tapered jig into the central through hole of the sharpener body and then inserting the blades with adhesion agent into the groves of the sharpener body so that the edges of the blades touch the taper surface of the tapered portion of the tapered jig.

7. Inserting the sharpener body with the blades into the cap case from the end without the screwing insert after adhering the powder spacer in the notch of the sharpener body and applying adhesion agent on its surface, then inserting and adhering the powder remover with the outlet ring inside the end, which the sharpener body is inserted from, so that the sharpener body joins against the remover body of which the flange is slightly spaced from the cap case end in order for the outlet ring to rotate freely.

DETAILED DESCRIPTION OF THE INVENTION

A lead-auto-sharpener propelling pencil according to the invention comprises a pencil body and a pencil cap.

The pencil body consists of a body case, a lead holder, a screwing sleeve, a lead, a bolt and a compression spring. On the outside of the front portion of the body case screwthread with outside screwthread is adhered to cooperate with the screwing insert that is in the pencil cap and is coaxial with the inside surface of the tapered portion formed at the front end of the body case 1.

The lead holder has a front tapered portion and a through hole which passes through the center of the holder along its longitudinal axis and is substantially coaxial with the front tapered portion. The diameter of the front portion of the through hole (that is, the portion at the front tapered portion of the holder) is less than that of its hind portion in order to snug the lead 3. There are several grooves uniformally formed circumferentially around the front tapered portion of the lead holder and extending radially to the through hole.

A lead is inserted in the lead holder, and is held by means of resilience of its front tapered grooved portion. The lead holder is arranged inside the body case with its front tapered portion fitting with the inside surface of the front taper portion of the body case so that the lead in automatically positioned along the longitudinal axis of the body case. The bolt is screwed in the hind end of the body while the compression spring is compressed between the bolt and the lead holder.

The pencil cap comprises a screwing insert, a cap case, a sharpener and a powder remover. The screwing insert is a hollow cylinder with inside screwthread. The cap case is cylindrical with hollow stepped chamber. The sharpener consists of a sharpener body, blades and a powder spacer. The sharpener body is cylindrical with a through hole in its center. A notch is formed at one of the ends of the sharpener body. Six blade insertion grooves, which extend axially and radially to the through hole of the sharpener body, are formed and spaced uniformally around the circumferential surface of the opposite end of the sharpener body. The blades of which the edges are inclined with respect to the longitudinal axis are adhered in these grooves, respectively, with their edges located on an imaginary cone which is coaxial with the through hole of the sharpener body. The powder spacer is seated on the other end of the sharpener body.

The powder remover consists of a remover body and an outlet ring. The remover body is cylindrical with a flange in one end and a through hole in the center. A powder hole is formed radially on its circumferential surface and connects with the through hole. The circular outlet ring also has a through hole on its circumferential surface and is rotationally installed around the remover body.

The screw insert is coaxially positioned in one end of the cap case while the sharpener is coaxially adhered inside the cap case from its other end where the powder remover is adhered.

The edges of the blades are inclined at an angle of $\alpha$ to the longitudinal axis. The angle $\alpha$ is 7°. The cross sectional configurations of the blades are symmetrical and its edge point angle $\beta$ is 36°.

And blades can alsc be Γ-shape and the cross sectional configuration of its edga can be asymmetrical while the cross sectional configurations of the blade insertion grooves have corresponding-shapes in order to cooperate with the blades.

In use, when the pencil body with a lead is inserted in the pencil cap with the outside screwthread of the screwing sleeve cooperating with the inside diameter of the screwing insert so that the lead in the pencil body is exactly positioned in the sharpener of the pencil cap centrally along the longitudinal axis cf the imaginary cone formed by the edges of the blades, the lead is sharpened automatically by turning the pencil cap.

Accordingly, when used to write, the lead has been automatically sharpened after directly twisting off the pencil cap and the propelling pencil with sharpened lead can be obtained without any further preparation. The lead powder in the sharpener passes through the powder spacer and is stored in the powder remover. When gathered to a certain amount it is removed by means of twisting the ring so that the though hole in the remover body is positioned correspondingly to the through hole in the outlet ring, see FIG. 10.

The process of making the lead-auto-sharpened propelling pencil according to the invention is as follows:

1. Making the body case and the screwing sleeve by the means of prior art, in which the concentricity between the screwing sleeve and the inside surface of the front tapered portion of the body case is ensured to be less than 0.1 mm.

2. Making the lead holder by the means of prior art, in which the concentricity, between its through hole and the outside surface of its front portion, is ensured to be less than 0.1 mm.

3. Making a cap case jig by tooling, in which the cap case jig is a stepped cylinder with the outside diameter of one of its end portions corresponding to the inside diameter of the screwing insert and the outside diameter of its other end portion to that of the sharpener body; and the concentricity between the two end portions is less than 0.05 mm.

4. Installing the screwing insert around the corresponding portion of the cap case jig so as to be a jig assembly to mould the cap case with a screwing insert by injection moulding.

5. Making a tapered jig by tooling. The tapered jig is a stepped cylinder with a tapered portion which has a corresponding cone to the portion of the lead sharpened. The cylindrical portion, which adjoins to the tapered portion, has a diameter corresponding to that of the central hole of the sharpener body. The total length of this portion and the tapered portion is equal to the longitudinal length of the sharpener body minus the depth of the notch.

6. Inserting the tapered jig into the central through hole of the sharpener body and then inserting the blades with adhesion agent into the grooves of the sharpener body so that the edges of the blades touch the taper surface of the tapered portion of the tapered jig.

7. Inserting the sharpener body with the blades into the cap case from the end without the screwing insert after adhering the powder spacer in the notch in the sharpener body and applying adhesion agent on its surface, then inserting and adhering the powder remover with the outlet ring inside the end, which the sharpener body is inserted from, so that the sharpener body joins against the remover body of which the flange is slightly spaced from the end of the cap case in order for the outlet ring to rotate freely.

To advantage, the features of this process of the invention lie in the use of a taper jig and a cap case jig so as to ensure the generally exactly relative positions of the parts of the assembly.

The propelling pencil made by the process provided by the invention can adapt to various thicker leads and ensure good alignment between the sharpener of the pencil cap and the lead to avoid breaking the lead during sharpening.

This process according to the present invention is simple, effectual and practical.

The propelling pencil according to the invention can adapt to various kinds of leads, and effectually replaces wood holder pencils to save a large amount of quality wood; and protect the environment because of a powder storing function of its powder remover.

Further objects and advantages of the present invention will appear from the following description taken together with the accompanying drawings.

EMBODIMENT OF THE INVENTION

Figure 1:
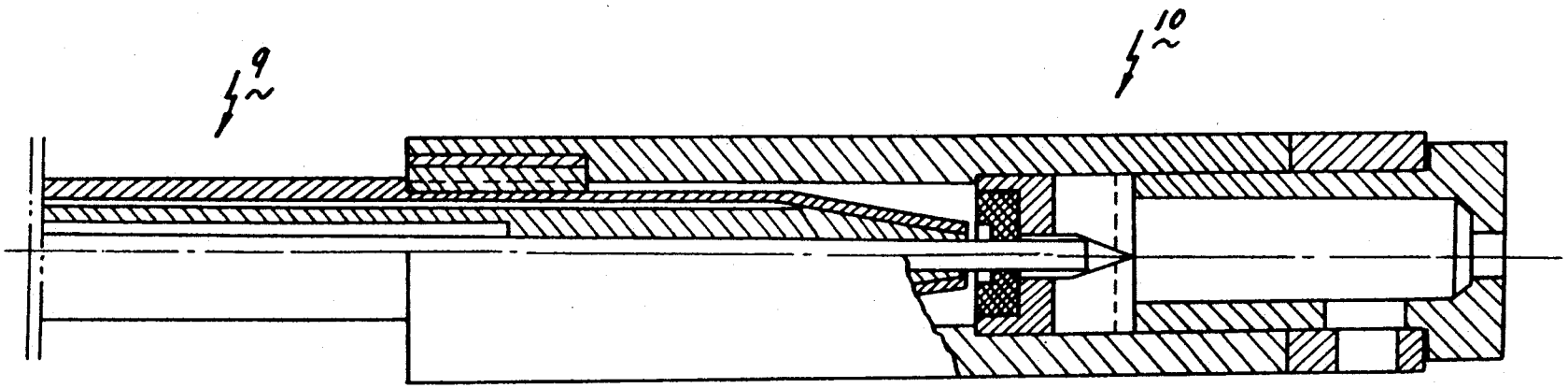
FIG. 1 is a schematic view of a portion of a propelling pencil assembly according to the invention.

Reference is first made to FIG. 1, a lead-auto-sharpened propelling pencil according to the invention comprises a pencil body 9 and a pencil cap 10.

Figure 2:
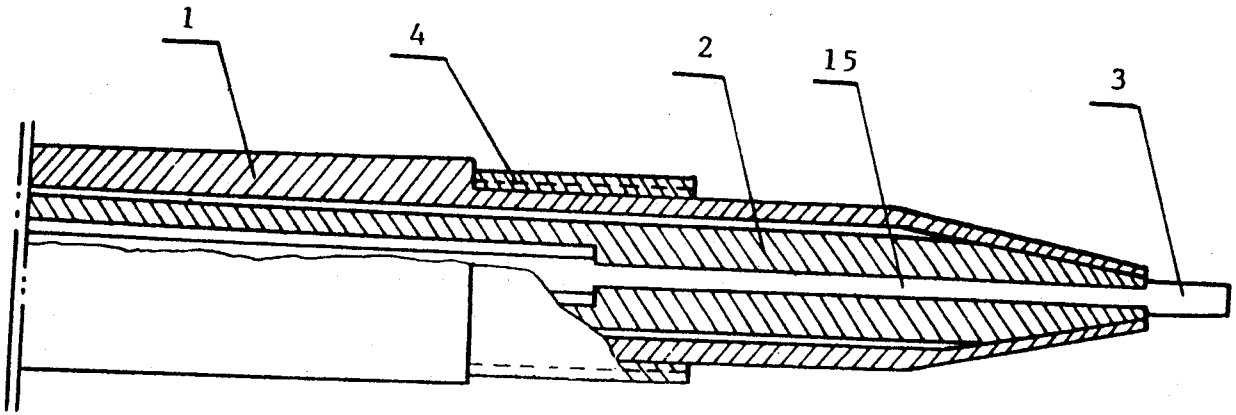
FIG. 2 is a schematic view of a portion of the pencil body assembly of the propelling pencil according to the invention.

The pencil body 9 consists of a body case 1, a lead holder 2, a lead 3, a screwing sleeve 4, as shown in FIG. 2, and a bolt and a compression spring (not shown). On the outside of the front portion of the body case 1 the screwing sleeve 4 with screwthread on its outside surface is installed in order to cooperate with a screwing insert in the pencil cap 10 and is coaxial with the inside surface of the tapered portion formed at the front end of the body case 1.

The lead holder 2 has a front tapered portion and a through hole which passes though the center of the holder 2 along its longitudinal axis and is substantially coaxial with the front tapered portion. The diameter of the front portion of the through hole (that is, the portion at the front tapered portion of the holder 2) is less than that of its hind portion in order to snug the lead 3. There are several grooves 15 uniformally formed circumferentially around the front tapered portion of the lead holder 2 and radially extending to the through hole.

A lead 3 is inserted in the lead holder 2, and is held by means of resilience of its front tapered grooved portion. The lead holder 2 is arranged inside the body case 1 with its front tapered portion fitting with the inside surface of the front taper portion of the body case 1 so that the lead 3 is automatically positioned along the longitudinal axis of the body case 1. The bolt is screwed in the hind end of the body 9 while the compression spring is compressed between the bolt and the lead holder 2.

Figure 3:
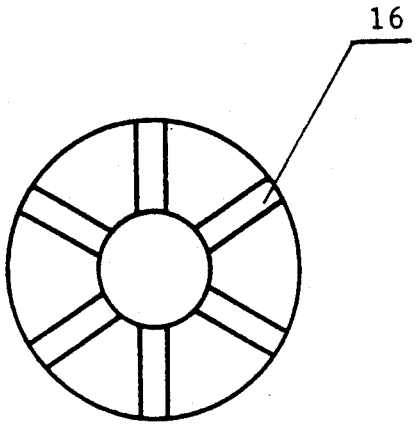
FIG. 3 is a schematic view of the sharpener of the propelling pencil according to the invention with the powder spacer and the blades removed.
Figure 4:
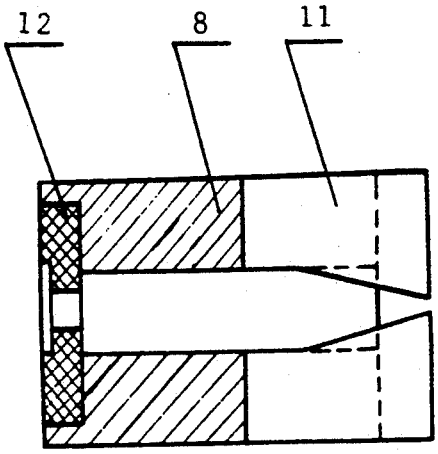
FIG. 4 is a sectional view of the sharpener of the propelling pencil according to the invention.
Figure 5:
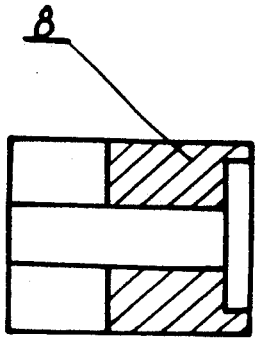
FIG. 5 is a schematic sectional view of the sharpener body of the propelling pencil according to the first embodiment of the invention.
Figure 9:
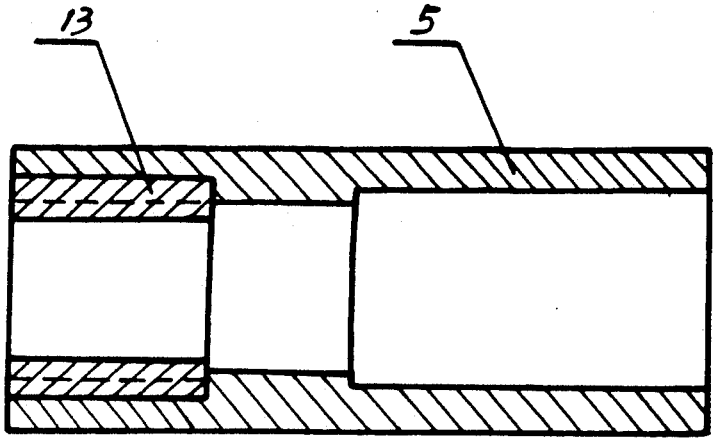
FIG. 9 is a schematic sectional view of the cap case, with the screwing insert, of a propelling pencil according to the invention.
Figure 10:
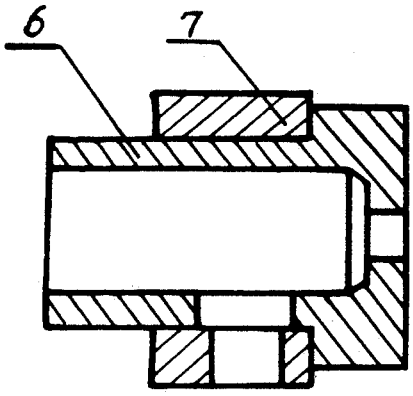
FIG. 10 is a schematic view of the powder remover assembly of the propelling pencil according to the invention.
Figure 11:
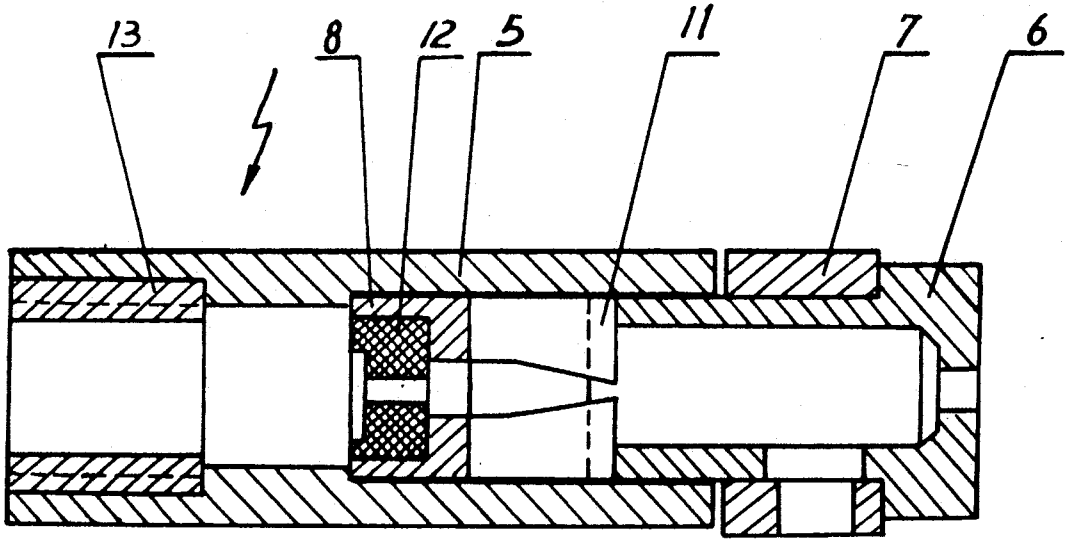
FIG. 11 is a schematic view of the pencil cap assembly of the propelling pencil of the invention.

The pencil cap 10 comprises a screwing insert 13, a cap case 5, a sharpener (FIG. 3 and FIG. 4) and a powder remover 6 (FIG. 10), as shown in FIG. 11. The screwing insert 13 shown in FIG. 9 is a hollow cylinder with inside screwthread. The cap case 5 is cylindrical with hollow stepped chamber. The sharpener, as shown in FIG. 3 and FIG. 4 consists of a sharpener body 8, blades 11 and a powder spacer 12. The sharpener body 8 shown in FIG. 5 is cylindrical with a through hole in its center. A notch is formed at one end of the sharpener body 8. Six blade insertion grooves 16 which extend axially and radially to the through hole of the sharpener body 8, are formed and spaced uniformally around the circumferential surface of the opposite end of the sharpener body 8. The blades 11 illustrated in FIGS. 6A and 6B, of which the edges are inclined with respect to its longitudinal axis, are adhered in these grooves, respectively, with their edges located on an imaginary cone which is coaxial with the through hole of the sharpener body 8. The powder spacer 12 (FIG. 4) is seated in the notched other end of the sharpener body 8.

As shown in FIG. 10, the powder remover consists of a remover body 6 and an outlet ring 7. The remover body 6 is cylindrical with a flange in one end and a throuh hole in the center. A powder hole is formed radially on its circumferential surface and connects with the through hole. The circular outlet ring 7 also has a through hole on its circumferential surface and is rotationally installed around the remover body 6.

As shown is FIG. 11, the screwing insert 13 is coaxially positioned in one end of the cap case 5 while the sharpener is coaxially adhered inside the cap case from its other end where the powder remover is adhered.

Figure 6A:
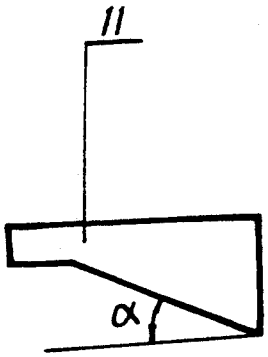
FIGS. 6A and 6B are, respectively, schematic front and side views of a blade, inserted into the sharpener body of FIG. 5, of the propelling pencil according to the invention.
Figure 6B:
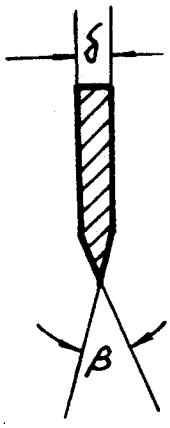

The edges of the blades 11 illustrated in FIGS. 6A and 6B are inclined at an angle of $\alpha$ with the longitudinal axis. The angle $\alpha$ is 7° in this embodiment. The cross sectional configurations of the blades are symmetrical and its edge point angle $\beta$ is 36°.

Figure 7A:
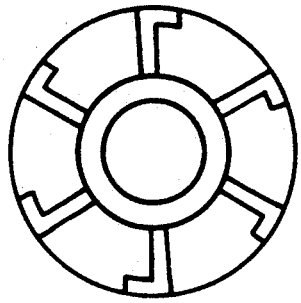
FIGS. 7A and 7B are, respectively, front and side sectional views of the sharpener body of the propelling pencil in another embodiment according to the invention.
Figure 7B:
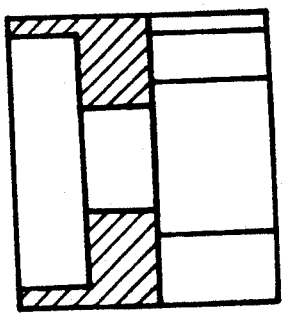
Figure 8A:
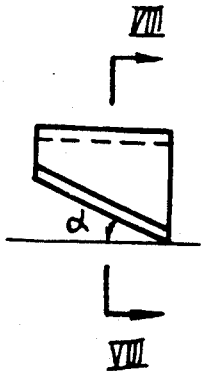
FIGS. 8A and 8B are, respectively, front and side views of the blade, inserted into the sharpener body of FIGS. 7A and 7B.
Figure 8B:
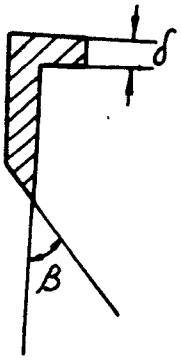

Another embodiment of the invention has the same structure as the first embodiment but for the blades and the sharpener body. As shown in FIGS. 8A and 8B, the blade is Γ-shape and the cross sectional configuration of its edge is asymmetrical. A side of the edge is straight while the other side is inclined. The sharpener body 8 illustrated in FIGS. 7A and 7B has six blade insertion grooves of Γ-shape in order to cooperate with the blades.

In use, when the pencil body 9 with a lead 3 is inserted in the pencil cap 10 with the outside screwthread of the screwing sleeve cooperating with the inside one of the screwing insert so that the lead 3 in the pencil body 9 is exactly positioned in the sharpener of the pencil cap 10 centrally along the longitudinal axis of the imagnary cone formed by the edges of the blades 11, the lead 3 is sharpened automatically by turning pencil cap 10.

Accordingly, when used to write, the lead 3 has been automatically sharpened after directly twisting off the pencil cap 10 and the propelling pencil with sharpened lead can be obtained without any further preparation. The lead powder in the sharpener passes through powder spacer 12 and is stored in the powder remover. When gathered to a certain amount it is removed by the means of twisting the ring 7 so that the through hole in the remover body 6 is aligned with the through hole in the outlet ring 7.

The process of making the lead-auto-sharpened propelling pencil according to the invention is as follows:

1. Making the body case 1 and the screwing sleeve 4 by the means of prior art, in which the concentricity between the screwing sleeve 4 and the inside surface of the front tapered portion of the body case 1 is ensured to be less than 0.1 mm.

2. Making the lead holder 2 by the means of prior art, in which the concentricity, between its through hole and the outside surface of its front portion, is ensured to be less than 0.1 mm.

Figure 12:
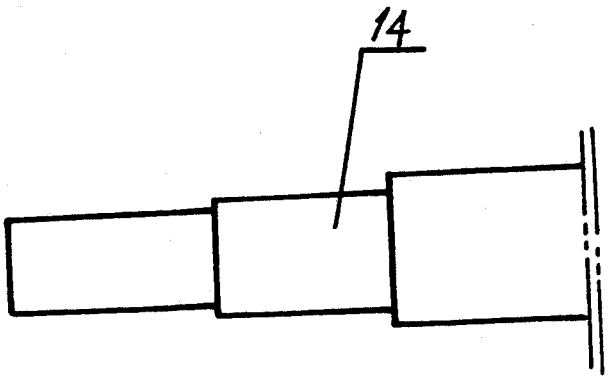
FIG. 12 is a schematic view of the cap case jig, used in the process of making the propelling pencil according to the invention.

3. Making a cap case jig 14 shown in FIG. 12 by tooling, in which the cap case jig 14 is a stepped cylinder with the outside diameter of one of its ends corresponding to the inside diameter of the screwing insert 13 and the outside diameter of its other end to that of the sharpener body 8; and the concentricity between the two ends is less than 0.05 mm.

4. Installing the screwing insert 13 around the corresponding portion of the cap case jig 14 so as to be a jig assembly to mould the cap case 5 with the screwing insert 13 by injection moulding.

Figure 13:
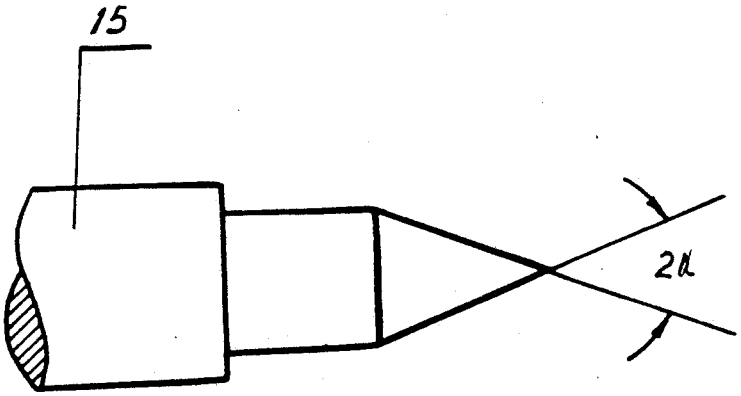
FIG. 13 is a schematic view of the tapered jig, used in the process of making the propelling pencil according to the invention.

5. Making a tapered jig 15 illustrated in FIG. 13 by tooling. The tapered jig 15 is a stepped cylinder with a tapered portion which has a corresponding cone to that of the lead sharpened. The cylindrical portion, which adjoins to the tapered portion, has a diameter corresponding to that of the central hole of the sharpener body 8. The total length of this portion and the tapered portion is equal to the longitudinal length of the sharpener body 8 with blades minus the depth of the notch.

6. Inserting the tapered jig 15 into the central through hole of the sharpener body 8 and then inserting the blades 11 with adhesion agent into the grooves of the sharpener body 8 so that the edges of the blades 11 touch the taper surface of the tapered portion of the tapered jig 15.

7. Inserting the sharpener body 8 with the blades 11 into the cap case 5 from the end without the screwing insert 13 after adhering the powder spacer 12 in the notch of the sharpener body 8 and applying adhesion agent on its surface, then inserting and adhering the powder remover with the outlet ring 7 inside the end, which the sharpener body 8 is inserted from, so that the sharpener body 8 joins against the remover body 6 of which the flange is slightly spaced from the end of the cap case 5 in order for the outlet ring 7 to rotate freely.

While the description of the lead-auto-sharpened propelling pencil and the process of making it have been given with respect to preferred embodiments, they are not to be construed in a limited sense. Variations and modifications will occur to those skilled in the art. Reference is made to the appended claims for a definition of the invention.

What is claimed is:

1. A lead-auto-sharpened propelling pencil which comprises a pencil body and a pencil cap;

said pencil body comprises a body case, a lead holder, a screwing sleeve, and a lead; said propelling pencil is characterized in that:

on the outside of the front portion of said body case, said screwing sleeve with outside screwthread is installed to cooperate with a screwing insert in said pencil cap, which insert is coaxial with the tapered surface formed inside the front end of said body case;

said lead holder has a front tapered portion and a through hole which passes through the center of said holder along its longitudinal axis and is substantially coaxial with the front tapered portion; the diameter of the front portion of said through hole is less than that of its hind portion in order to snug said lead; there are several grooves uniformally formed circumferentially around the front tapered portion of said lead holder and radially extending to said through hole;

a lead is inserted in said lead holder, and is held by means of resilience of the front tapered grooved portion of said lead holder; said lead holder is arranged inside the body case with its front tapered portion fitting with the inside surface of the front tapered portion of said body case so that said lead is automatically positioned along the longitudinal axis of said body case;

said pencil cap comprising a screwing insert, a cap case, a sharpener and a powder remover; said screwing insert is a hollow cylinder with inside screwthread; said cap case is cylindrical with a hollow stepped chamber; said sharpener consists of a sharpener body, blades and a powder spacer, said sharpener body is cylindrical with a through hole in its center; a notch is formed at one of the ends of said sharpener body; six blade insertion grooves which extend axially and radially to the through holes are formed and spaced uniformlly around the circumferential surface of the other end portions of the sharpener body; the blades, of which the edges are inclined with respect to its longitudinal axis, are adhered in these grooves, respectively, with their edges located on an imaginary cone which is coaxial with the through hole of said sharpener body; said powder spacer is seated on said notch of said sharpener body;

the powder remover consists of a remover body and an outlet ring; said removed body is cylindrical with a flange in one end and a through hole in the center; a powder hole is radially formed on its circumferential surface and connects with the through hole; and said circular outlet ring also has a through hole on its circumferential surface and is rotationally installed around said remover body; said screwing insert is coaxially positioned at one end of said cap case while said sharpener is coaxially adhered inside said cap case from its other end where said powder remover is adhered.

2. A lead-auto-sharpened propelling pencil as claimed in claim 1 wherein said cross sectional configuration of said blade is symmetrical.

3. A lead-auto-sharpened propelling pencil as claimed in claim 1, wherein said blade is Γ-shape and the cross sectional configuration of its edge is asymmetrical.

4. A process of making the lead-auto-sharpened propelling pencil as recited in claim 1 is characterized in that:

(1) making said body case and said screwing sleeve by the emans of prior art, in which the concentricity between the screwing sleeve and the inside surface of the front tapered portion of the body case is ensured to be less than 0.1 mm;

(2) making said lead holder by the means of prior art, in which the concentricity, between its through hole and the outside surface of its front portion, is ensured to be less than 0.1 mm;

(3) making a cap case jig by tooling, in which, said cap case jig is stepped cylinder with the outside diameter of one of its end portions corresponding to the inside diameter of said screwing insertion and the outside diameter of its other end portion to that of said sharpener body; and the concentricity between the two end portions is less than 0.005 mm;

(4) installing said screwing insert around the corresponding portion of said cap case jig so as to be a jig assembly to mould said cap case with said screwing by injection moulding;

(5) making a tapered jig by tooling, in which, said tapered jig is a stepped cylinder with a tapered portion with a corresponding cone to the portion of the lead sharpened; the cylindrial portion, which adjoins the tapered portion, has a diameter corresponding to that of the central hole of said sharpener body; the total length of this portion and the tapered portion is equal to the longitudinal length of said sharpener body with said blades minus the depth of said notch;

(6) inserting said tapered jig into the central through hole of said sharpener body and then inserting said blades with adhesion agent into teh grooves of said sharpener body so that the edges of said blades touch the taper surface of the tapered portion of said tapered jig;

(7) inserting said sharpener body with said blades into said cap case from the end without said screwing insert after adhering said powder spacer in said notch of said sharpener body and applying adhesion agent on its surface, then inserting and adhering said powder remover with the outlet ring inside the end, which said sharpener body is inserted from, so that said sharpener body jointes against said remover body of which the flange is slightly spaced from the cap case end in order for the outlet ring to rotate freely.

* * * * *